US010799935B2

(12) United States Patent
LeFevre et al.

(10) Patent No.: US 10,799,935 B2
(45) Date of Patent: Oct. 13, 2020

(54) LID SEAMING APPARATUS WITH SMALL ANGLE ENGAGEMENT

(71) Applicant: Twin Monkeys Beverage Systems, Inc., Aurora, CO (US)

(72) Inventors: Brian F. LeFevre, Brighton, CO (US); Josh VanRiper, Denver, CO (US); Thomas A. Wightman, Lakewood, CO (US)

(73) Assignee: Twin Monkeys Beverage Systems, Inc., Aurora, CO (US)

( * ) Notice: Subject to any disclaimer, the term of this patent is extended or adjusted under 35 U.S.C. 154(b) by 204 days.

(21) Appl. No.: 16/200,386

(22) Filed: Nov. 26, 2018

(65) Prior Publication Data

US 2019/0240719 A1 Aug. 8, 2019

Related U.S. Application Data

(60) Provisional application No. 62/628,065, filed on Feb. 8, 2018.

(51) Int. Cl.

| | |
|---|---|
| ***B21D 51/32*** | (2006.01) |
| ***B65B 7/28*** | (2006.01) |
| ***B21D 51/26*** | (2006.01) |

(52) U.S. Cl.

CPC ..... *B21D 51/32* (2013.01); *B21D 51/2653* (2013.01); *B65B 7/285* (2013.01)

(58) Field of Classification Search

CPC .... B21D 51/30; B21D 51/32; B21D 51/2653; B21D 51/2661; B65B 7/285; B65B 7/2857; B65B 7/2892

USPC ..... 413/6, 31, 36

See application file for complete search history.

(56) References Cited

U.S. PATENT DOCUMENTS

| | | | | |
|---|---|---|---|---|
| 2,522,301 | A * | 9/1950 | Rooney | B21D 51/32 413/31 |
| 5,505,572 | A * | 4/1996 | Fujimori | B21D 51/2653 413/6 |
| 9,545,656 | B2 * | 1/2017 | Aldred | B21D 51/32 |
| 2005/0207871 | A1 * | 9/2005 | Carrein | B21D 51/2692 413/45 |
| 2007/0248437 | A1 * | 10/2007 | Rudd | B21D 51/32 413/27 |
| 2017/0312803 | A1 * | 11/2017 | Grumm | B21D 51/2692 |

FOREIGN PATENT DOCUMENTS

| | | | | |
|---|---|---|---|---|
| GB | 595501 | A * | 12/1947 | B21D 51/32 |

* cited by examiner

*Primary Examiner* — Shelley M Self
*Assistant Examiner* — Katie L. Parr
(74) *Attorney, Agent, or Firm* — Cochran Freund & Young LLC; William W. Cochran

(57) ABSTRACT

Disclosed is a lid seaming apparatus that uses a seam forming roller and a seam sealer roller that move in a direction that is substantially parallel or is preferably less than 10 degrees from a tangent line drawn through the intersection point of the seam forming roller and the seam sealer roller with a seaming chuck. A displacement between the seaming chuck and the seam sealer roller that is slightly less than the thickness of a sealed seam allows for a high degree of adjustment and the creation of forces that are sufficient to cause the seam to properly seal.

17 Claims, 11 Drawing Sheets

LID SEAMING APPARATUS WITH SMALL ANGLE ENGAGEMENT

BACKGROUND OF THE INVENTION

Thin-walled aluminum cans have been important for the packaging industry. Many different products are sold in thin-walled aluminum cans, including various drinks. Thin-walled aluminum cans normally compromise two pieces, i.e., the body portion and the lid. Once the body portion is filled with a liquid, the lid can be applied and sealed to the body portion with a seam.

SUMMARY OF THE INVENTION

An embodiment of the present invention may therefore comprise a method of seaming a lid to a can comprising: positioning a can lid and can in a rotary seaming chuck so that the can lid and the can rotate in response to rotation of the seaming chuck; moving a seam forming roller in a direction towards the seaming chuck that forms an angle of less than approximately 45 degrees with a tangent line that is tangent to the seaming chuck at an intersection point of a fully sealed seam and the seam forming roller; moving a seam sealer roller in a direction towards the seaming chuck that forms an angle of less than approximately 45 degrees with a tangent line that is tangent to the seaming chuck at an intersection point of a sealed seam and the seam sealer roller.

An embodiment of the present invention may also comprise a lid seaming apparatus comprising: a seaming chuck that receives a can lid on a can and spins the can lid and can on a base; a seam forming roller that is mounted on a seam forming translating mechanism that moves the seam forming roller in a direction towards the seaming chuck that forms an angle of less than approximately 45 degrees with a tangent line that is tangent to the seaming chuck at an intersection point of a fully sealed seam and the seam forming roller; a seam sealer roller that is mounted on a seam sealer translating mechanism that moves in a direction towards the seaming chuck that forms an angle of less than approximately 45 degrees with a tangent line that is tangent to the seaming chuck at an intersection point of a sealed seam and the seam sealer roller.

DETAILED DESCRIPTION OF THE EMBODIMENTS

Figure 1:
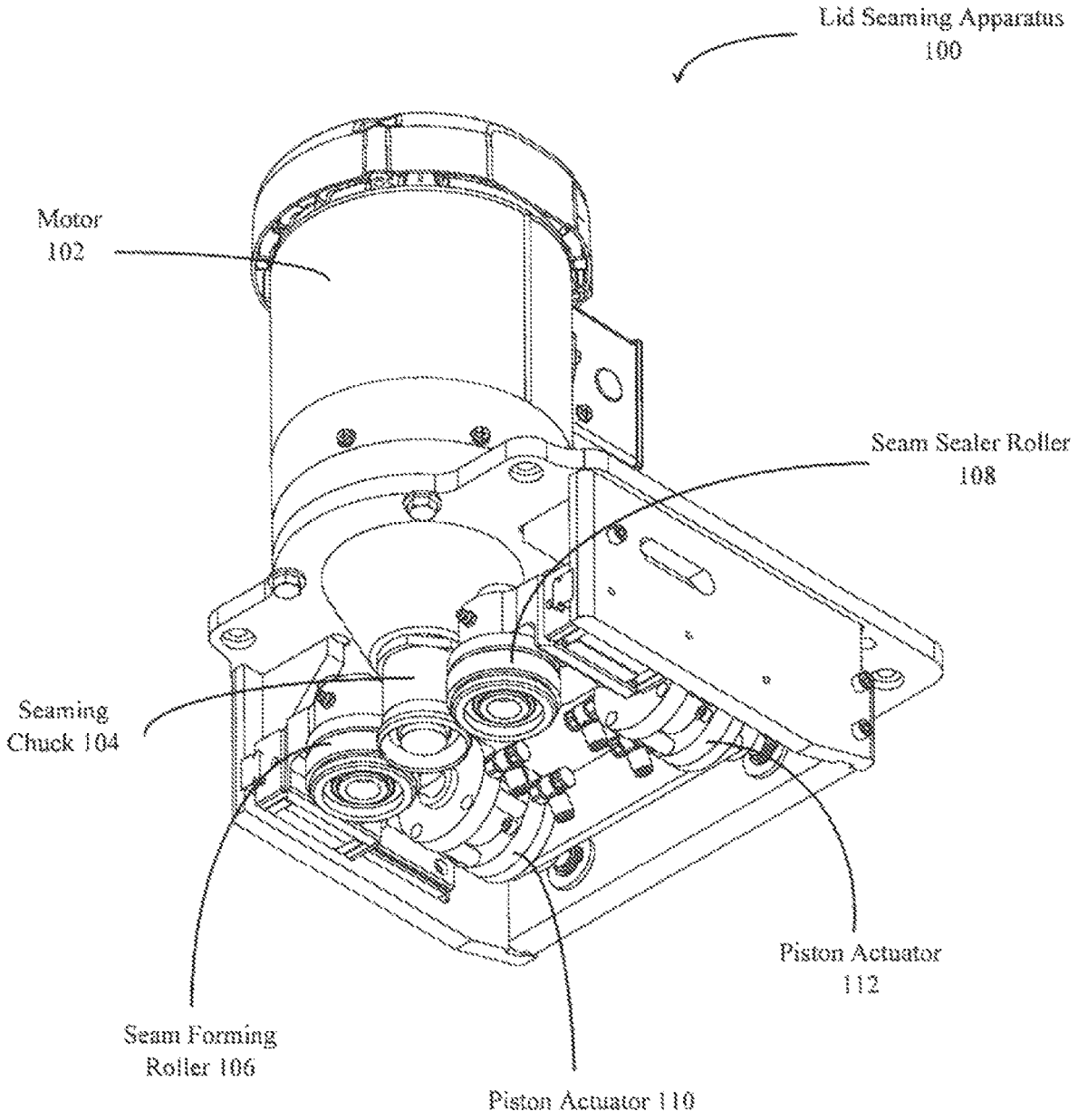
FIG. 1 is a perspective view of an embodiment of a lid seaming apparatus.

FIG. 1 is an isometric view of a lid seaming apparatus 100 that comprises an embodiment of the present invention. As illustrated in FIG. 1, the lid seaming apparatus 100 has a motor 102 that is coupled to the seaming chuck 104 and causes the seaming chuck 104 to rotate. Prior to reaching the lid seaming apparatus 100, cans are filled with a product such as a liquid. The liquid can comprise any liquid such as a soft drink liquid, beer, water, etc. The lid seaming apparatus 100 can also be used to seal cans with other contents such as food, etc. For purposes of this application, it will be assumed that beer is the preferred product that will be contained in the can. The cans are filled individually and fed by conveyer and lids are placed over the open portion of the can. The lids can he placed by hand or automatically by an automated lid placing device. Each can is then individually moved to a location that is directly under the seaming chuck 104. A lift device (not shown) lifts the can so that the lid is aligned and engaged with the seaming chuck 104. The can lift device applies pressure between the lid and the seaming chuck 104 and has a rotatable base. When motor 102 rotates the seaming chuck 104 the can spins because of the force between the lid and the seaming chuck 104. The lid seaming apparatus includes a seam forming roller 106 and a seam sealer roller 108. The seam forming roller 106 engages the can lid in response to piston actuator 110. The piston actuator 110 moves the seam forming roller 106 into a position where the seam forming roller 106 folds the can lid into the can body as the can rotates on the seaming chuck 104, as explained in more detail below. In this manner, a seam is formed between the can lid and the can body as a result of the actuation of the seam forming roller 106. After a seam is formed, the seam sealer roller 108 is actuated by a piston actuator 112. The seam sealer roller engages the seam that has been formed between the lid and the can body and seals the seam by generating force between the seam sealer roller 108 and the seaming chuck 104. This is explained in more detail below.

Figure 2:
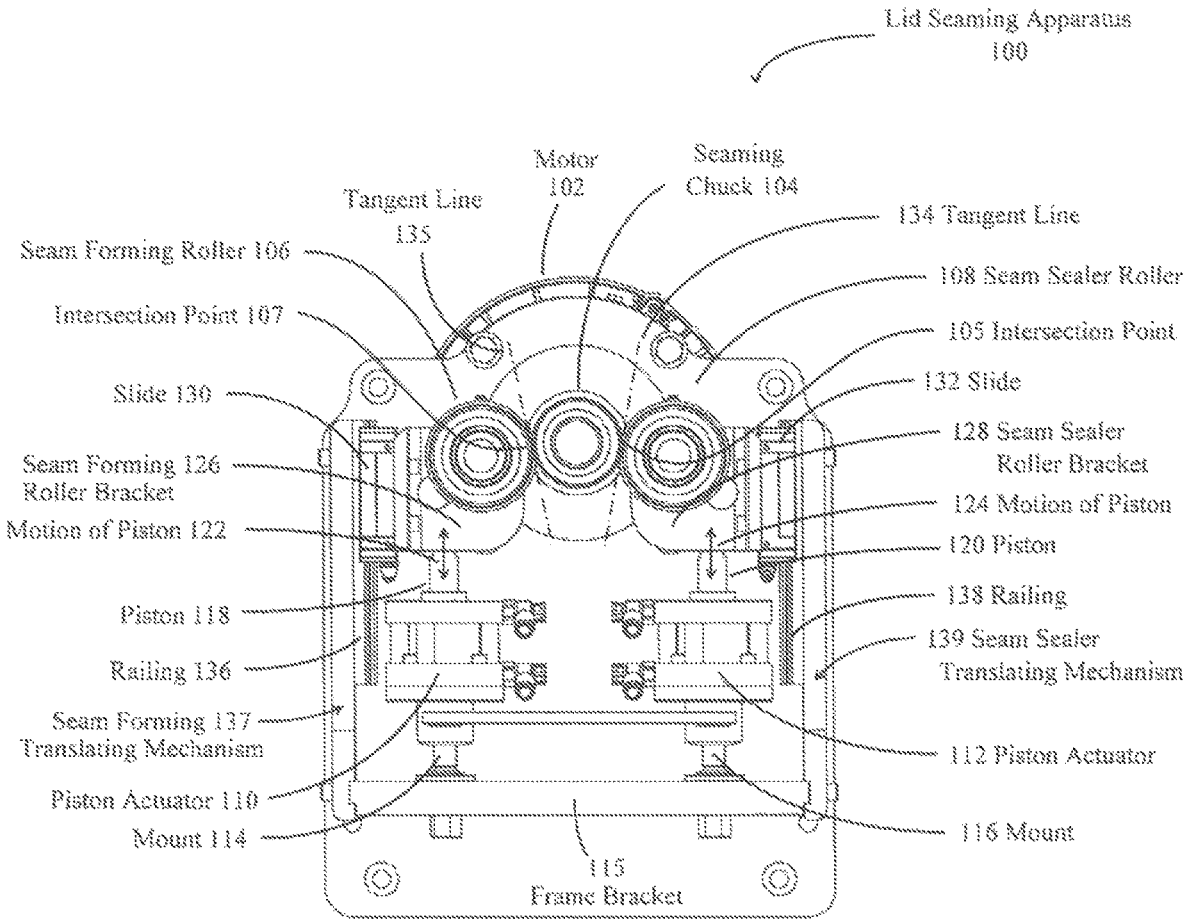
FIG. 2 is a bottom view of the lid seaming apparatus of FIG. 1.

FIG. 2 is a bottom view of the lid seaming apparatus 100 illustrated in FIG. 1. As shown in FIG. 2, the motor 102 is disposed directly above the seaming chuck 104 and causes the seaming chuck 104 to rotate. Seam forming roller 106 is illustrated in FIG. 2 in a forward position where the seam forming roller 106 engages the seaming chuck 104 at intersection point 107. Similarly, seam sealer roller 108 is illustrated in a forward position, so that the seam sealer roller 108 engages the seaming chuck 104 at intersection point 105. The seam forming roller 106 and seam sealer roller 108 engage the seaming chuck in a sequential fashion. The seam forming roller 106 engages the seaming chuck 104 first, to form the seal between the can lid and the can body. The seam sealer roller 108 subsequently engages the seaming chuck 104, to seal the seam between the can lid and the can body, as shown in more detail below. Tangent line 135 indicates the tangent of the intersection point 107 where the seam forming roller 106 engages the seaming chuck 104. Similarly, tangent line 134 is the tangent at the intersection point 105 where the seam sealer roller 108 engages the seaming chuck 104. The seam forming roller 106 and the seam sealer roller 108 move in a direction that is vertical on FIG. 2. The seam forming roller translating mechanism 137 includes the piston actuator 110, mount 114, the piston 118, the seam forming roller bracket 126, railing 136 and slide 130. Similarly, the seam sealer translating mechanism 139 comprises the piston actuator 112, mount 116, piston 120, scam sealer roller bracket 128, railing 138 and slide 132. The seam forming roller 106 is mounted on the seam forming roller bracket 126. The seam forming roller bracket 126 is attached to piston 118. Piston 118 moves as indicated by the arrow 122 illustrating the motion of the piston 118. The piston actuator 110 causes the piston 118 to move in accordance with the direction of the arrow 122. The seam forming roller bracket 126 is mounted on a slide 130 which is attached to a railing 136. In this manner, the seam forming roller bracket 126 and the seam forming roller 106 move in the direction of the arrow 122, which is nearly parallel to the tangent line 135. Piston actuator 110 is mounted by a mount 114 to a frame bracket 115. Since the tangent line 135 is nearly or substantially parallel to the motion of the seam forming roller 106 as indicated by arrow 122, a large degree of adjustment of the amount of pressure between the seam forming roller 106 and the seaming chuck 104 at intersection point 107 can be achieved in comparison to a movement of the seam forming roller 106 that is more perpendicular to the tangent line 135.

Similarly, piston 120 subsequently moves the seam sealer roller bracket 128 in the direction of the arrow 124 until the seam sealer roller 108 engages the seaming chuck 104. Tangent line 134 is the tangent of the intersection of the seaming chuck 104 and the seam sealer roller 108, which is nearly or substantially parallel to the motion of the piston as indicated by arrow 124. As used herein, the terms "nearly" and "substantially" means a few degrees and less than 10 degrees. Piston actuator 112 causes the piston 120 to move as indicated by arrow 124 so that the seam sealer roller 108 engages the seaming chuck 104 at intersection point 105. The seam sealer roller bracket 128 is mounted on a slide 132 which engages railing 138 and causes the seam sealer roller 108 to move in the direction of the arrow 124. The piston actuator 112 is mounted to a frame bracket 115 by mount 116. Again, a high degree of adjustability with regard to the force that is applied by the seam sealer roller 108 to a seam of the can and lid is achieved since the tangent line 134 is nearly parallel with the motion of the seam sealer roller 108, as indicated by arrow 124. In other words, movement of the piston 120 causes the seam sealer roller 108 to engage the seaming chuck 104 that has the seam of the lid and can body dispersed around the seaming chuck 104. Since the tangent line 134 is nearly parallel with the motion of the piston, as indicated by arrow 124, a greater amount of movement is utilized to create the forces between the seam sealer roller 108 and seaming chuck 104 to create a desired force on the seam of a lid than if the movement of the seam sealer roller 108 was more perpendicular to the tangent line 134.

The piston actuators 110, 112, as shown in FIGS. 1 and 2, can be either pneumatic or hydraulic actuators. Alternatively, the piston actuators 110, 112 can be servo motors, stepper motors, screw actuators or cam actuated, create the movement of the pistons 118, 120. In fact, any type of actuator can be used to create and control the movement of pistons 118, 120.

Figure 3:
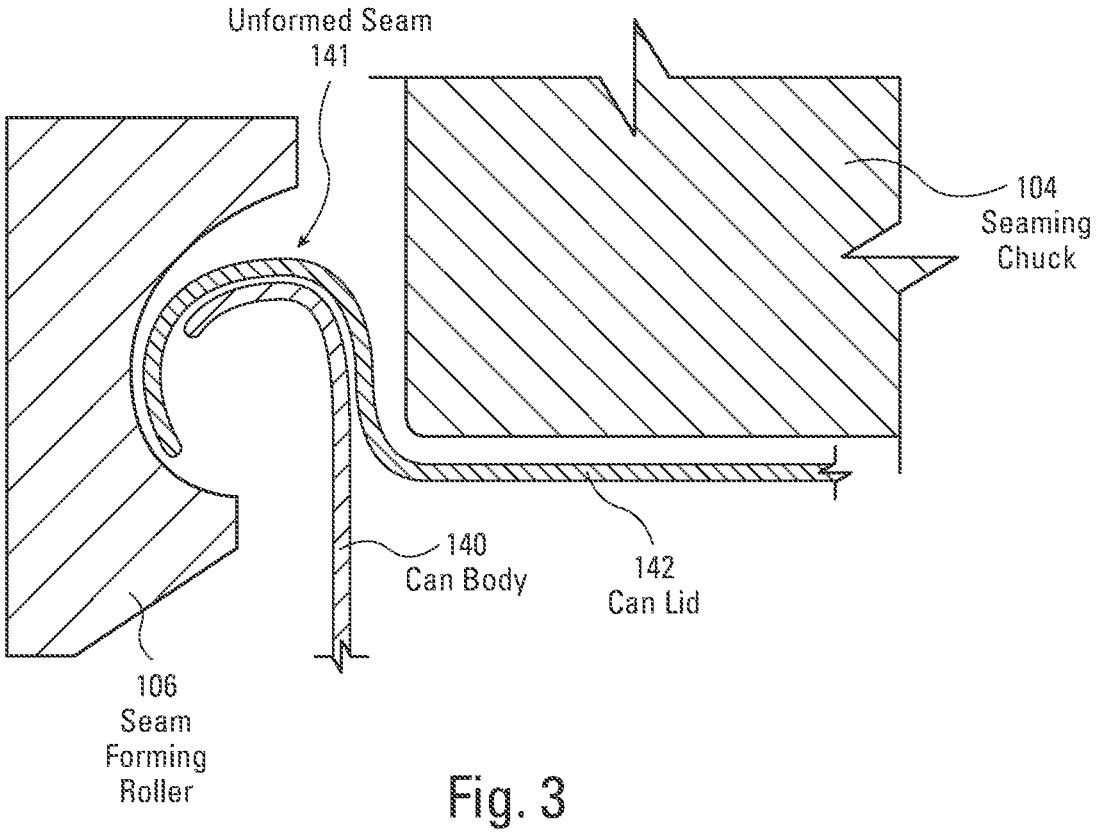
FIGS. 3 through 5 are a schematic cross-sectional diagram illustrating the manner in which a seam forming roller forms a seam between a can lid and a can body.
Figure 4:
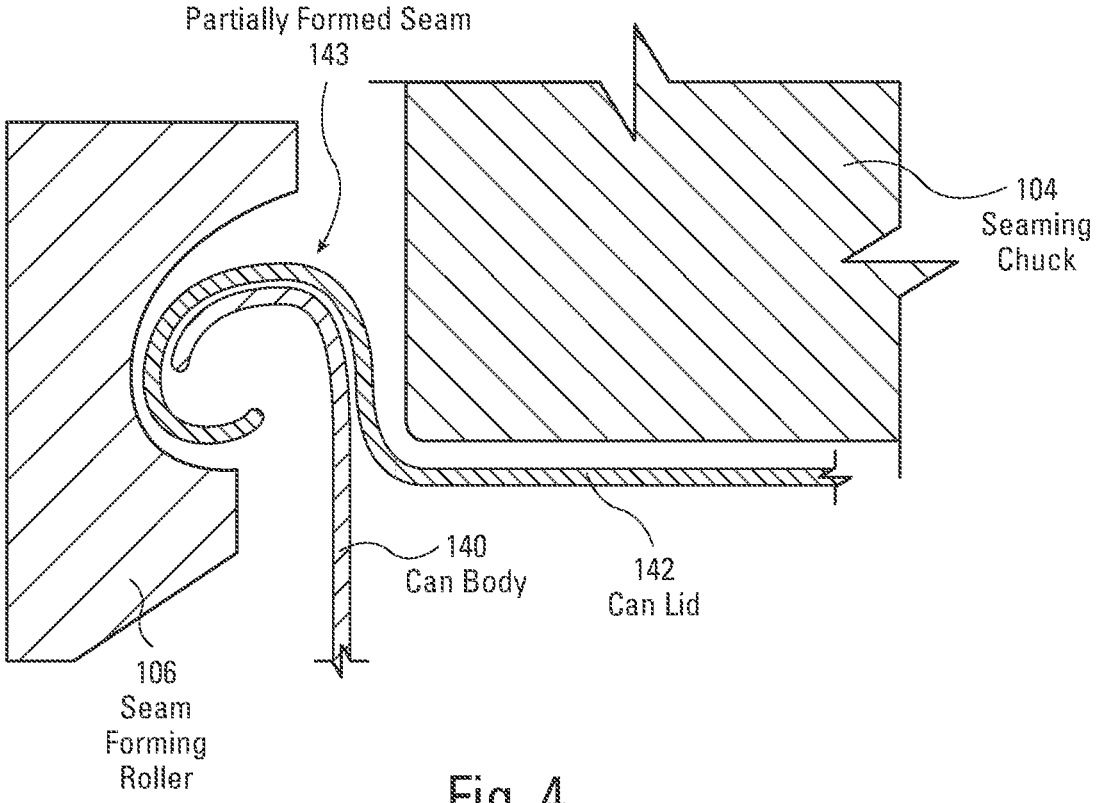
Figure 5:
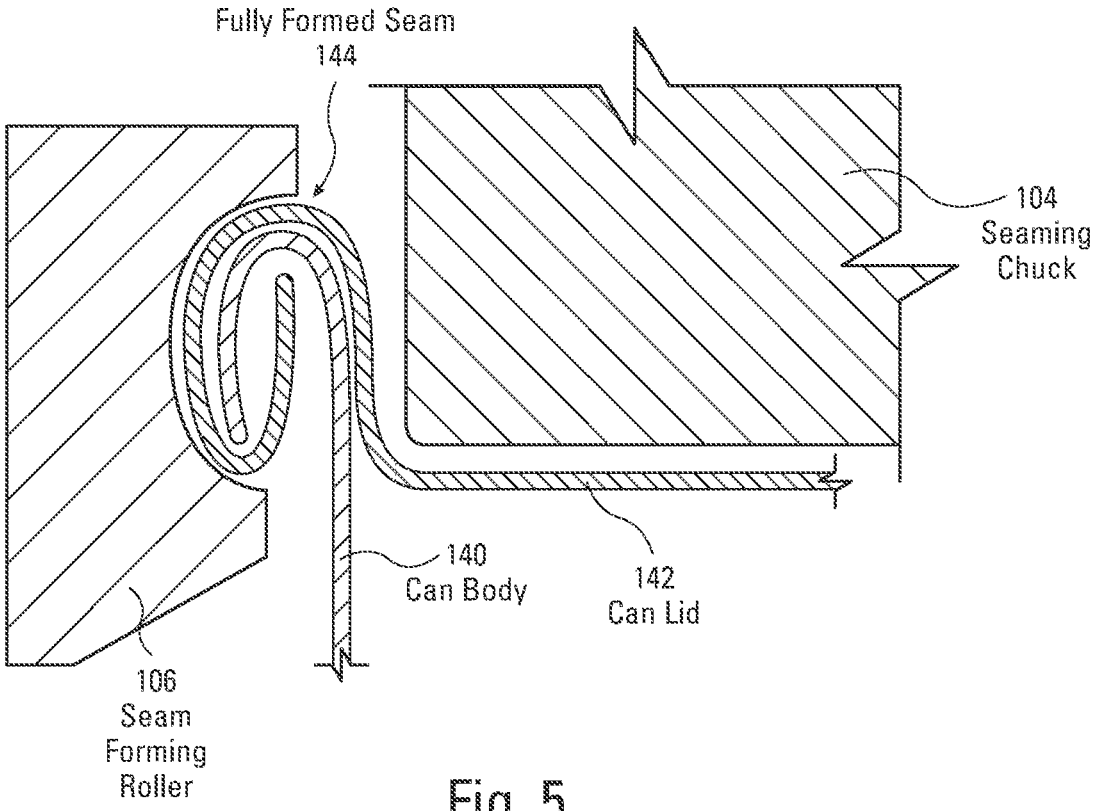

FIGS. 3 through 5 illustrate the manner in which a seam is created between a can lid 142 and a can body 140. As illustrated in FIG. 3, the seaming chuck 104 sits in the top portion of the can lid 142. The seam forming roller 106 engages the can lid 142 and can body 140. The can lid 142 has a shape, such as shown in FIG. 3, when the can lid 142 is constructed. The can lid 142 is placed on the can body 140 that has a shape such as shown in FIG. 3. These shapes have been shown in modified form to illustrate the manner in which a fully formed seam is created. The can lid 142 and the can body 140 have pre-formed shapes and the can lid 142 can be placed directly on the can body 140, in the manner shown in FIG. 3, to create the unformed seam 141.

FIG. 4 illustrates the manner in which the seam forming roller 106 can be moved towards the seaming chuck 104 to cause the curved shapes of the can lid 142 and the can body 140 to bend and curve inwardly towards each other to create a partially formed seam 143.

FIG. 5 illustrates the manner in which the can body 140 and the can lid 142 are curled together as the seam forming roller 106 moves towards the seaming chuck 104 and causes the curves in the canned body 140 and canned lid 142 to engage each other and form a fully formed seam 144.

Figure 6:
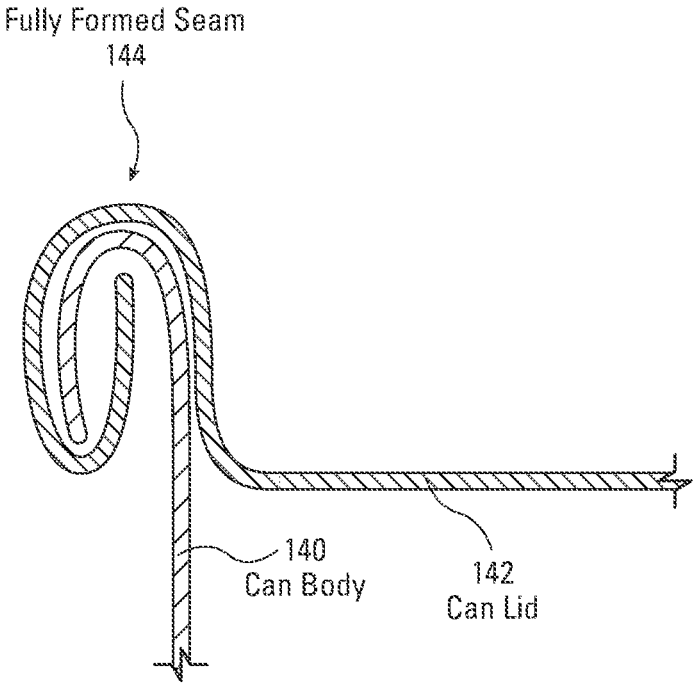
FIG. 6 is a cross-sectional diagram of a seam that has not been sealed.

FIG. 6 is a schematic cross-sectional diagram illustrating the fully formed seam 144 that is created between the can lid 142 and the can body 140 as a result of the seam forming roller 106 engaging the pre-curved shapes of the can lid 142 and can body 140. The fully formed seam 144 is a seam that is not sealed by the seam sealer roller 108. In other words, the seam forming roller 106 illustrated in FIGS. 1 and 2 has formed the seam as a result of the seam forming roller 106 moving into a position to engage the seaming chuck 104, (FIGS. 1 and 2). The action of the seam forming roller 106 is the first step in sealing the lid to the can body. The second step includes the movement of the seam sealer roller 108 to engage the fully formed seam 144 while the lid is disposed in the seaming chuck 104. This process is explained in more detail below.

Figure 7:
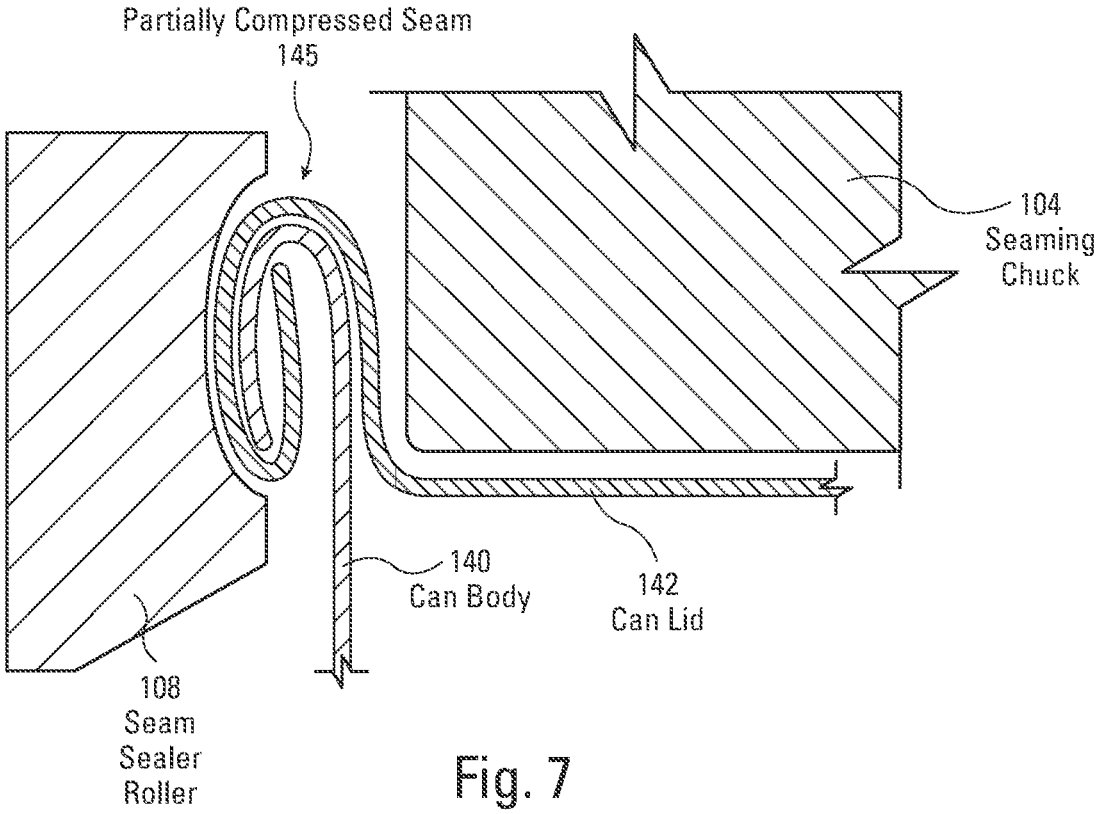
FIGS. 7, 8, and 9 illustrate the manner in which a seam sealer roller seals a seam.

FIG. 7 is a schematic cross-sectional diagram illustrating the initial engagement of the seam sealer roller 108 with the fully formed seam 144 (FIG. 6) to create a partially compressed seam 145. As shown in FIG. 7, the seaming chuck 104 is disposed inside the can lid 142. The seam sealer roller 108 is moved in a linear direction, as shown by arrow 124 of FIG. 2, to engage the fully formed seam 144 and create the partially compressed seam 145. The seaming chuck 104 is rotating which causes the partially compressed seam 145 to rotate, which, in turn, causes the seam sealer roller 108 to rotate, so that the entire surface of the partially compressed seam 145 is contacted by the seam sealer roller 108.

Figure 8:
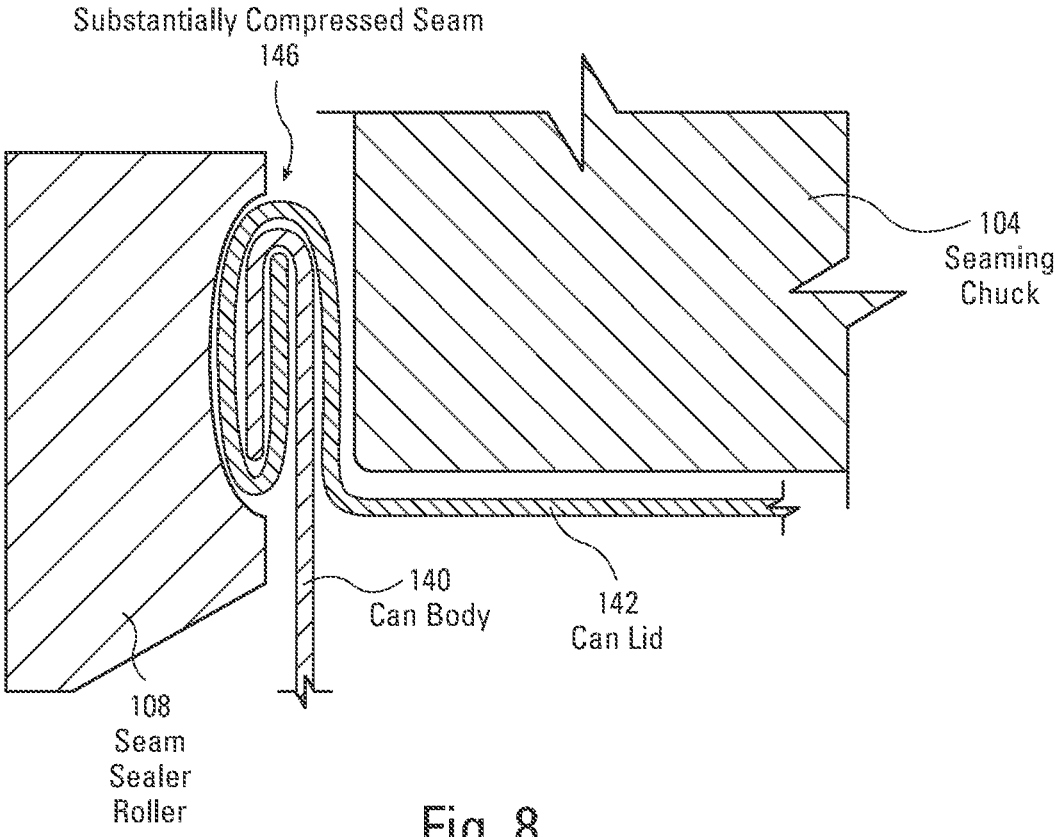

FIG. 8 is another cross-sectional diagram illustrating the seam sealer roller 108 which has moved closer to the seaming chuck. 104 and applies a force to the partially compressed seam 145 to create the substantially compressed seam 146. The substantially compressed seam 146, which comprises a portion of the can lid 142 and can body 140, is pushed inwardly toward the seaming chuck 104 to begin the process of creating a fully sealed seam 147 (FIG. 9).

Figure 9:
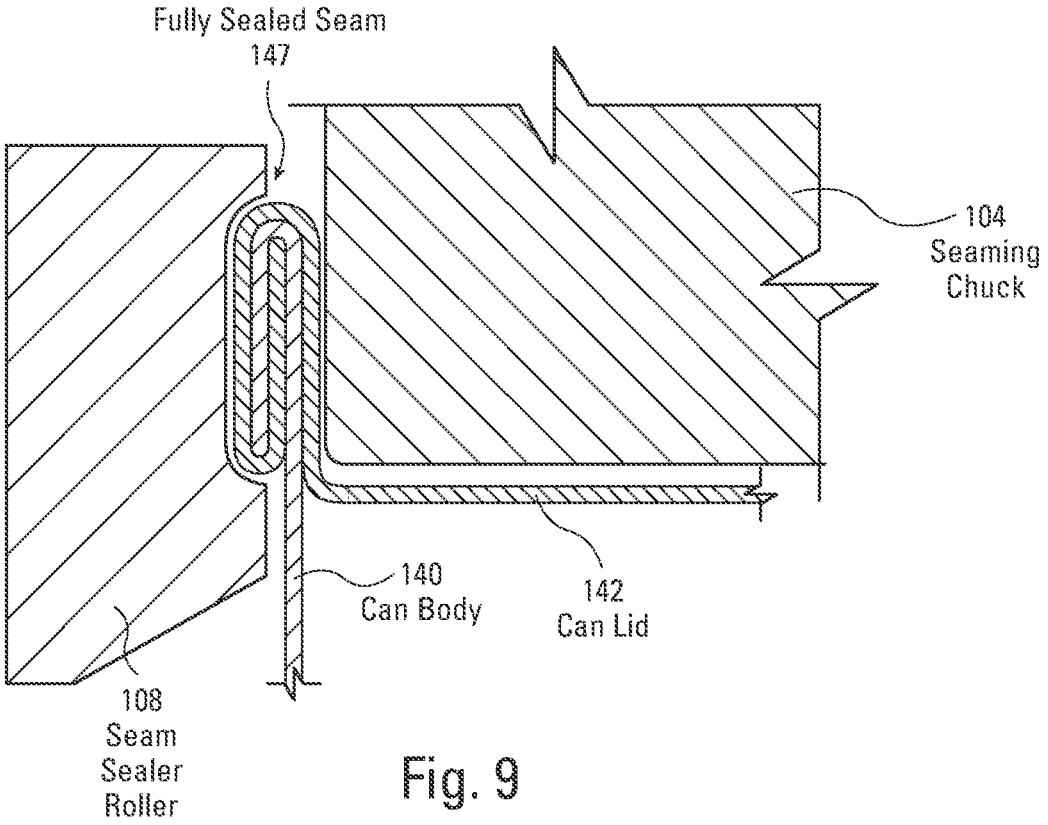

FIG. 9 is another cross-sectional diagram illustrating the seam sealer roller 108 in a fully engaged position against the seam 144. The seam sealer roller 108 has moved towards the seaming chuck 104 which applies pressure against the seam 144 and causes the substantially compressed seam 146 (FIG. 8) to close to form a fully sealed seam 147. The malleable nature of the aluminum of the can lid 142 and can body 140 causes the fully sealed seam 147 to create a hermetic seal between the can body 140 and can lid 142. Sealer material can also be used on the can lid 142 and/or can body 140 to further ensure a seal. In the position illustrated in FIG. 9, the seam sealer roller 108 has moved to a position such as illustrated in FIG. 2 to fully engage the fully sealed seam 147 and create a sufficient amount of force to cause the malleable aluminum of the can body 140 and can lid 142 to seal together and create a long lasting fully formed seam 147 that creates a hermetic seal. Pressures of up to 1000 pounds can he generated by the seam sealer roller 108 pushing against the seam 144 and the seaming chuck 104 in accordance with the configuration illustrated. The life of the contents of the can is extended by months and years as a result of the superior hermetic seal that is created using these high forces that have not previously been obtainable using prior art seam sealers. Because of the lateral motion of the seam sealer roller 108 with respect to the seaming chuck 104, as illustrated by arrow 124 of FIG. 2, a high degree of adjustability in the amount of force that is applied by the seam sealer roller 108 to the seam 144 can be achieved.

Figure 10:
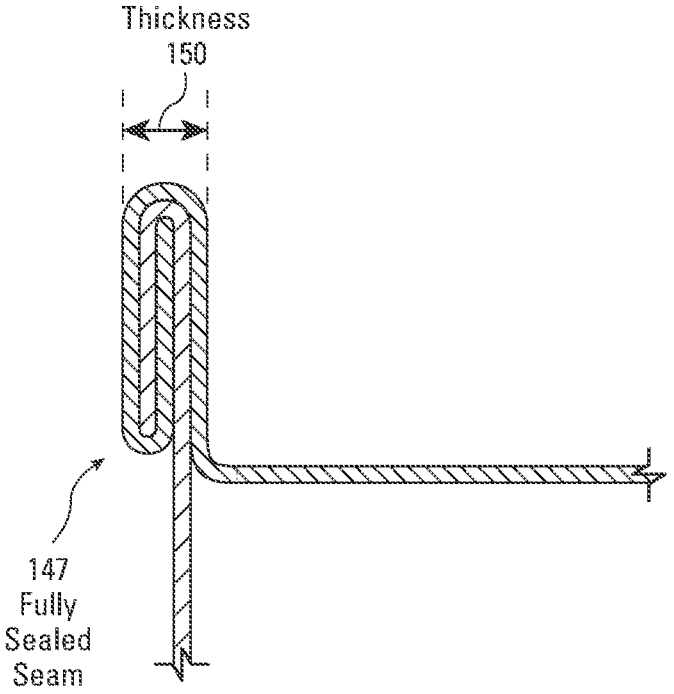
FIG. 10 is a schematic cross-sectional diagram of a seam that has been sealed.

FIG. 10 is a cross-sectional view of the fully sealed seam 147 after the fully formed seam 144 (FIGS. 5 and 6) is sealed by the seam sealer roller 108 (FIG. 9). The fully sealed seam 147 has a thickness 150 which is less than the thickness of the fully formed seam 144, that is illustrated in FIG. 6. The thickness 150 of the fully sealed seam 147 can be utilized in determining the overlap or displacement 186, 194 (FIGS. 14 and 17) between the seaming chuck 104 and the seam sealer roller 108. In other words, the seam sealer roller 108, illustrated in FIG. 2, moves linearly in the direction of the arrow 124 so that the seaming chuck 104 and the seam sealer roller 108 intersect. The amount of displacement 186 (FIG. 14) between the seaming chuck 104 and the seam sealer roller 108 determines the location of the intersection point 105, as illustrated in FIG. 2. The displacement 186 (FIG. 14) also determines the degree of adjustability for creating the fully sealed seam 147, that is explained in more detail below.

Figure 11:
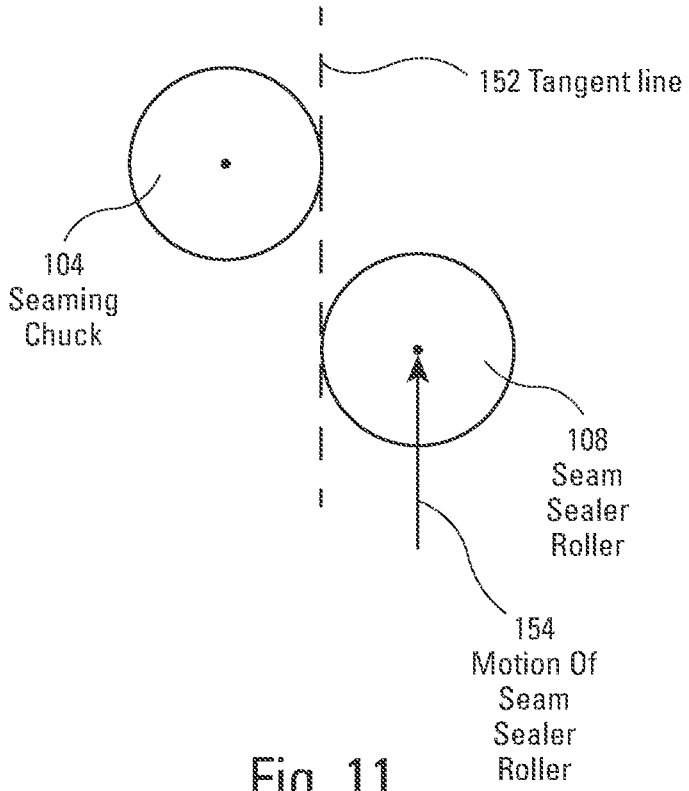
FIG. 11 is a schematic diagram illustrating the manner in which the seam sealer roller of the present invention moves to engage a seaming chuck.

FIG. 11 is a schematic illustration of the movement of a seam sealer roller 10$ with respect to a seaming chuck 104. The seam sealer roller 108 moves in the direction of 154 along a tangent line 152.

Figure 12:
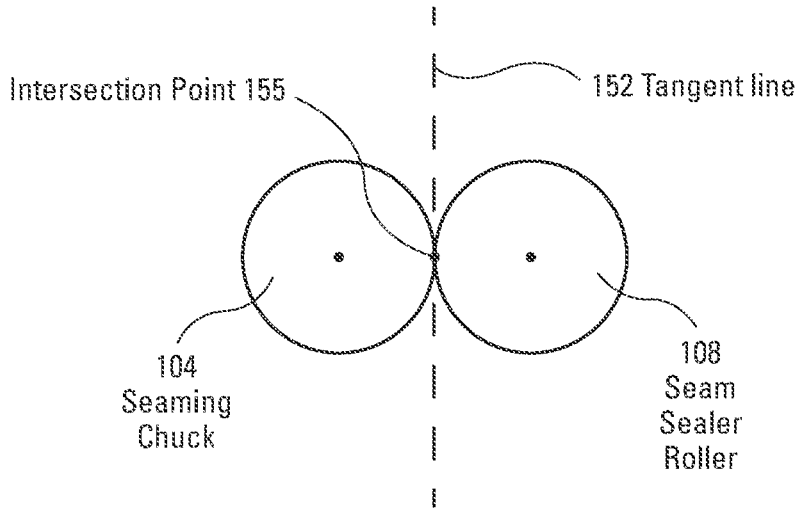
FIG. 12 is a schematic illustration showing the scam sealer roller engaging the seaming chuck at an intersection point.

As illustrated in FIG. 12, in an ideal configuration, the seam sealer roller 108 intersects the seaming chuck 104 at intersection point 155 which is along the tangent line 152. In other words, the motion 154 of the seam sealer roller 108 is parallel to the tangent line 152. This is an ideal situation in which there is an offset between the seaming chuck 104 and the seam sealer roller 108 so that the seaming chuck 104 and seam sealer roller 108 are spaced apart by the thickness 150 of the fully sealed seam 147 (FIG. 10) so that the tangent line 152 is parallel to the motion of the seam sealer roller 154, in this ideal situation.

Figure 13:
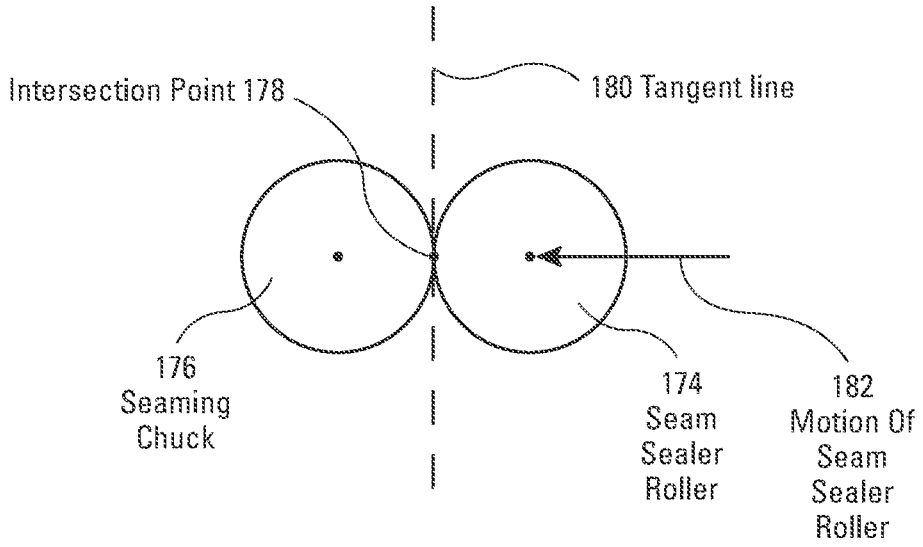
Fig. 13 PRIOR ART
FIG. 13 is a schematic illustration showing the manner in which the seam sealer roller moves towards the seaming chuck to create an intersection point in accordance with prior art devices.

FIG. 13 is a schematic illustration of the manner in which the seam sealer roller 174 intersects the seaming chuck 176 in accordance with prior art devices such as disclosed in U.S. Pat. No. 9,545,656 issued Jan. 17, 2017 and which is specifically incorporated herein for all that it discloses and teaches. As shown in FIG. 13, the motion 182 of the seam sealer roller 174 is substantially perpendicular to the tangent line 180. This does not allow for a high degree of adjustment since only a slight motion 182 in a direction perpendicular to the tangent line 180 creates the intersection at the intersection point 178 with little or no ability to adjust the motion 182 of the seam sealer roller 174. In this manner, adjustment of the motion 182 of the seam sealer roller 174 is not provided by the movement 182 of the seam sealer roller at an angle that is approximately perpendicular to the tangent line 180.

Figure 14:
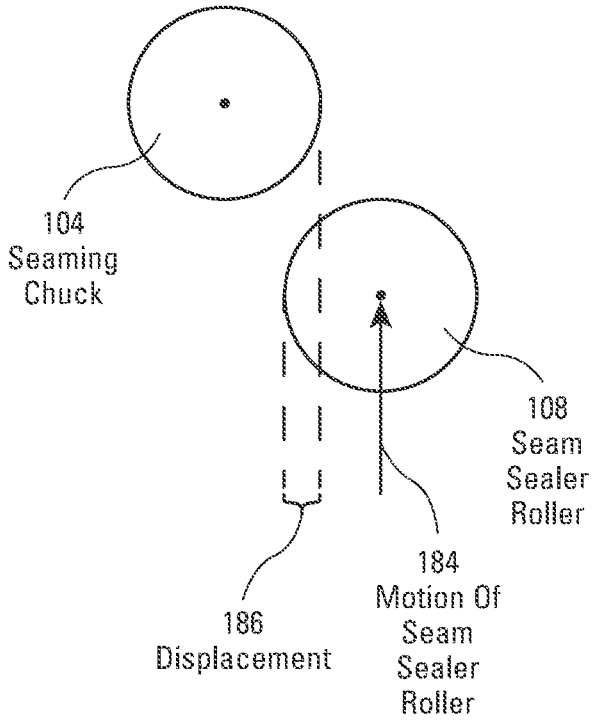
FIG. 14 is a schematic illustration showing the motion of the seam sealer roller with respect to the seaming chuck with a displacement between the seam sealer roller and the seaming chuck.

FIG. 14 is a schematic diagram illustrating a seaming chuck 104 and a seam sealer roller 108 that has a motion 184. Seaming chuck 104 and the seam sealer roller 108 have an overlap or displacement 186 when the seam sealer roller 108 has a motion 184 that is illustrated in FIG. 14.

Figure 15:
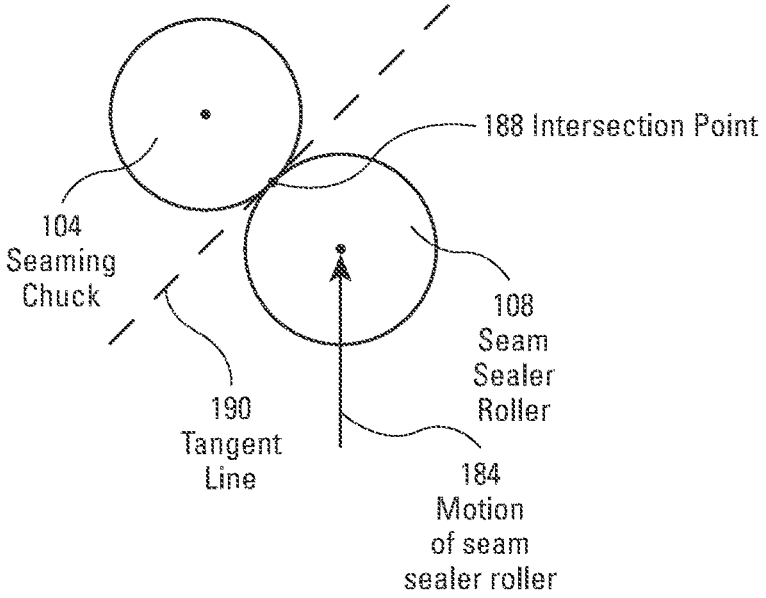
FIG. 15 is a schematic illustration showing the manner in which the seam sealer roller engages the seaming chuck at the intersection point with the displacement illustrated in FIG. 14.

As shown in FIG. 15, the displacement 186 (FIG. 14) creates an intersection point 188 between the seaming chuck 104 and the seam sealer roller 108. This results in a tangent line 190, which runs through intersection point 188, that forms an angle with the motion 184 of the seam sealer roller. The angle between the tangent line 190 and the motion 184 of the seam sealer roller is approximately 45 degrees. As the angle increases, there is less adjustment of the position of the seam sealer roller 108 and a lesser ability to create the desired force at the intersection point 188. At low angles of approximately 10 degrees, as illustrated in FIG. 2, a much larger amount of adjustment can be used to vary the force at the intersection point 105 of FIG. 2 and greater forces can be created. The amount of adjustment to create the desired force and the ability to create a large force falls off non-linearly as the angle between the tangent line, such as tangent line 190, and the motion of the seam sealer roller, such as motion 184, increases. For example, as shown in FIG. 13, the angle between the motion 182 of the seam sealer roller and the tangent line 180 is 90 degrees, which provides the lowest amount of adjustment of the motion of the seam sealer roller to create the desired force at the intersection point 178 of FIG. 13 and the least amount of force at the intersection point for the amount of force applied to the seam sealer roller 174.

Figure 16:
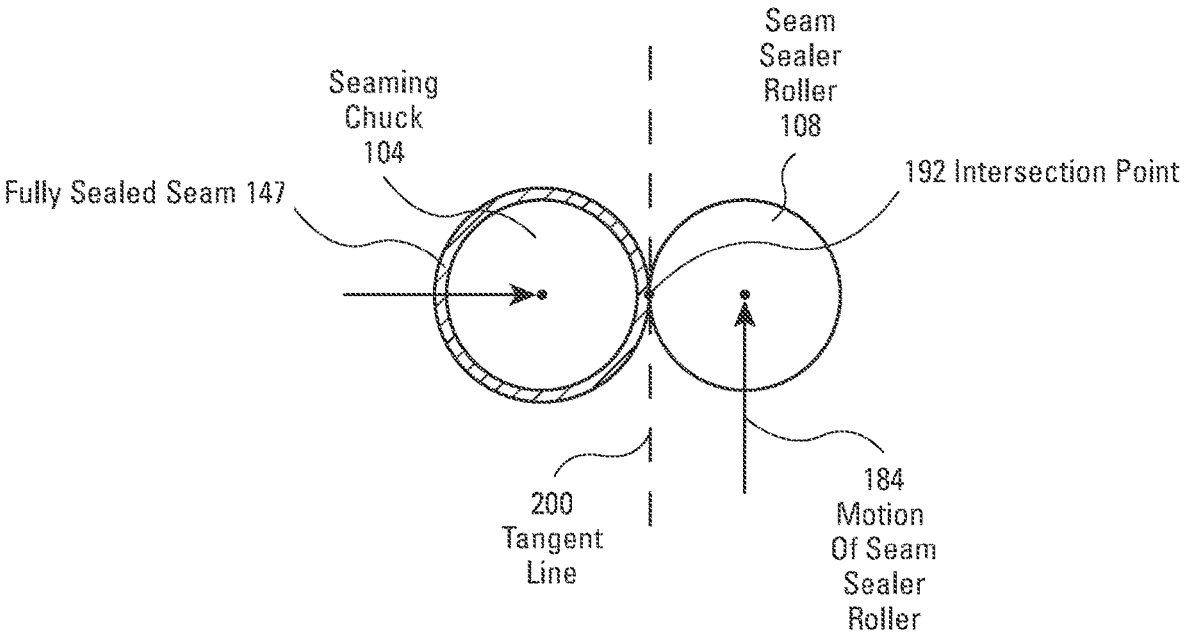
FIG. 16 is a schematic illustration showing the intersection of the seam sealer roller with a fully sealed seam in an ideal situation.

Accordingly, the displacement 186 illustrated in FIG. 14, between the seaming chuck 104 and the seam sealer roller 108, determines the location of the intersection point, such as intersection point 188 of FIG. 15, and consequently determines the angle of the tangent line 190. The smaller the displacement 186, the more parallel the tangent line 190 becomes to the motion 184 of the seam sealer roller, as shown in FIG. 16. The displacement 186 can be set to zero minus the thickness of the desired seam such as thickness 150 of seam 144, as illustrated in FIG. 10. Practically, the displacement 186 should be set to zero plus a number slightly less than the thickness 150 of the seam 144 to ensure that a sufficient amount of force is created on the seam 144 to cause the seam 144 to seal properly. If the displacement 186 is set to zero plus an amount slightly less than the thickness 150 illustrated in FIG. 10, the tangent lines, such as tangent line 190, will be very close to being parallel to the motion line 184 of the seam sealer roller 108. In that case, a large amount of adjustment of the force applied to the intersection point 188 can be achieved. In addition, the force that must be applied to the seam sealer roller 108 to create the motion 184, when the displacement 186 is set to zero plus thickness 150, is significantly less than the force necessary to create an equal amount of force at the intersection 178 of FIG. 13, as a result of the nearly perpendicular motion 182 of the seam sealer roller.

The increased forces created when there is a small angle between the tangent line and the motion line of the seam sealer roller is a result of the wedging effect that the seam sealer roller 108 has with respect to the seaming chuck 104. Two circular surfaces are being brought together. As shown in FIG. 2, the seaming chuck 104 is mounted in the lid seaming apparatus 100 in a stationary position, but spins on its axis. The wedging occurs when the seam sealer translating mechanism 139 moves the seam sealer roller 108 so that the seam sealer roller 108 contacts the seaming chuck 104 and creates a wedging effect between the seaming chuck 104 and the railing 138. The amount of force required to move the piston 120 in the direction of motion 124 is significantly less to create a large force at the intersection point 105, because of the wedging, than the force required to move the seam sealer roller 108 in a perpendicular direction as shown in FIG. 13. The force vectors (not shown) allow the force along the motion line 124 to create large force vectors at the intersection point 105 between the seaming chuck 104 and the seam sealer roller 108. As such, greater adjustment and greater forces can be achieved when a small angle exists between the tangent line, such as tangent line 190 and the motion line, such as motion line 184 of the seam sealer roller, and greater forces can be created at the intersection point 188 for a given amount of force applied to the seam sealer roller 108 that is moving in the direction 184, as illustrated in FIG. 15. It is therefore doubly beneficial to have a very small displacement and space the die surfaces of the seaming chuck 104 and the seam sealer roller by an amount that is slightly less than the thickness of the desired sealed seam, since greater adjustability can be achieved and higher forces can be achieved. Slightly less can be a displacement of approximately 1% of the desired thickness 150 of the sealed seam 144 to approximately 99% of the thickness 150. At angles greater than 45 degrees between the tangent line 190 and the motion 184 of the seam sealer roller, the benefits are significantly less since both the adjustability and the applied force fall off nonlinearly with the increase in the angle between the tangent 190 and the motion 184 of the seam sealer roller. Angles of 10 degrees or less are most beneficial, however, angles of up to 45 degrees provide some benefit and are certainly better than a perpendicular motion of the seam sealer roller, such as illustrated in FIG. 13.

FIG. 16 is a schematic illustration of the manner in which a seam sealer roller 108 contacts a fully sealed seam 196 on a seaming chuck 104. As illustrated in FIG. 16, the seam sealer roller 108 has a linear movement 184 that is substantially parallel to the tangent line 200, which passes through the intersection point 192. The seam sealer roller 108 is spaced from the seaming chuck 104, i.e. has a displacement, from the seaming chuck 104, so that a fully sealed seam 196 is formed when the seam sealer roller 108 moves into the position illustrated in FIG. 16.

Figure 17:
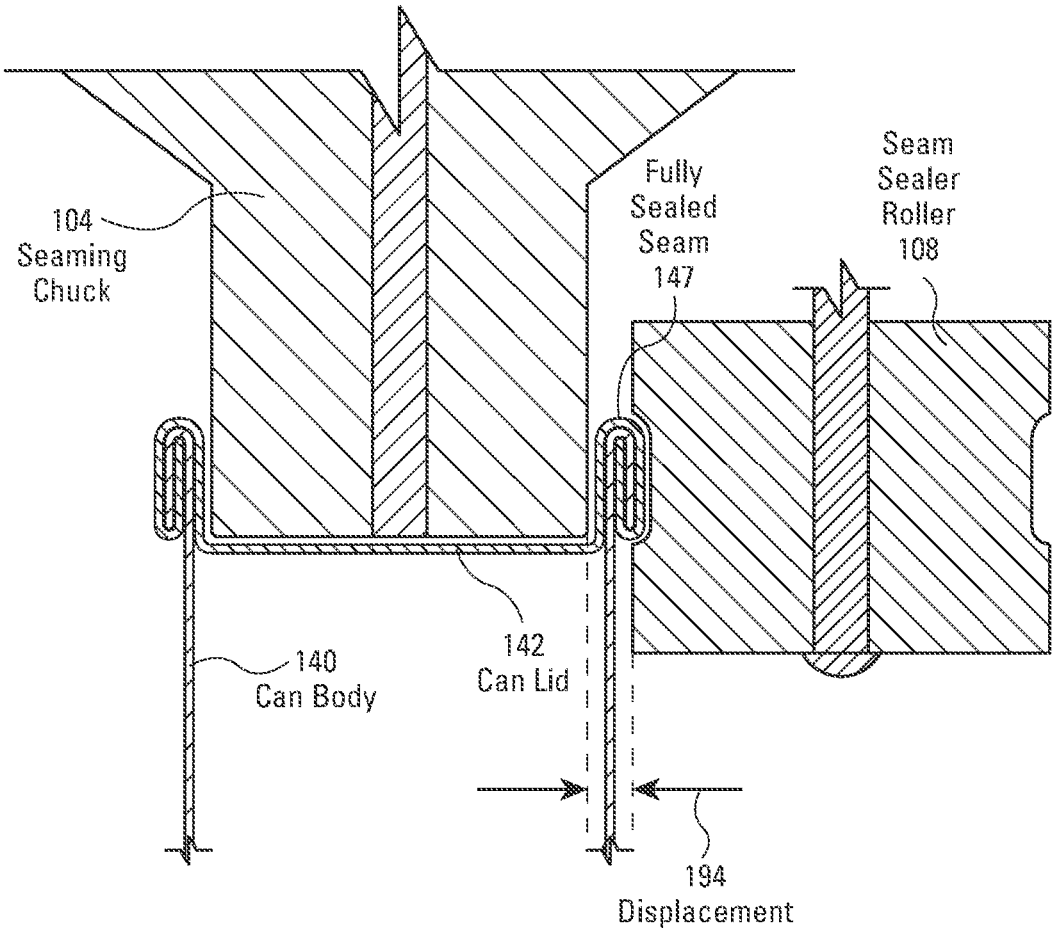
FIG. 17 is a cross-sectional view of a seam sealer roller engaging a seam disposed on a seaming chuck.

FIG. 17 is an enlarged side cross-sectional view illustrating the seam sealer roller 108 in the position illustrated in FIG. 16. A fully sealed seam 147 surrounds the seaming chuck 104. The seam sealer roller 108 has moved into the position illustrated in FIG. 16, so that the seam is fully sealed as a result of pressure by the seam sealer roller 108 against the seaming chuck 104. The displacement 194 of the seam sealer roller 108 from the seaming chuck 104 is approximately the thickness of the fully sealed seam 147 or slightly less than the thickness of the fully sealed seam 147. This results in the motion 184 (FIG. 16) of the seam sealer roller 108 to be approximately parallel to the tangent line 200, when the seam sealer roller 108 has compressed the seam so that the fully sealed seam 147 is fully sealed, as illustrated in FIG. 16.

Figure 18:
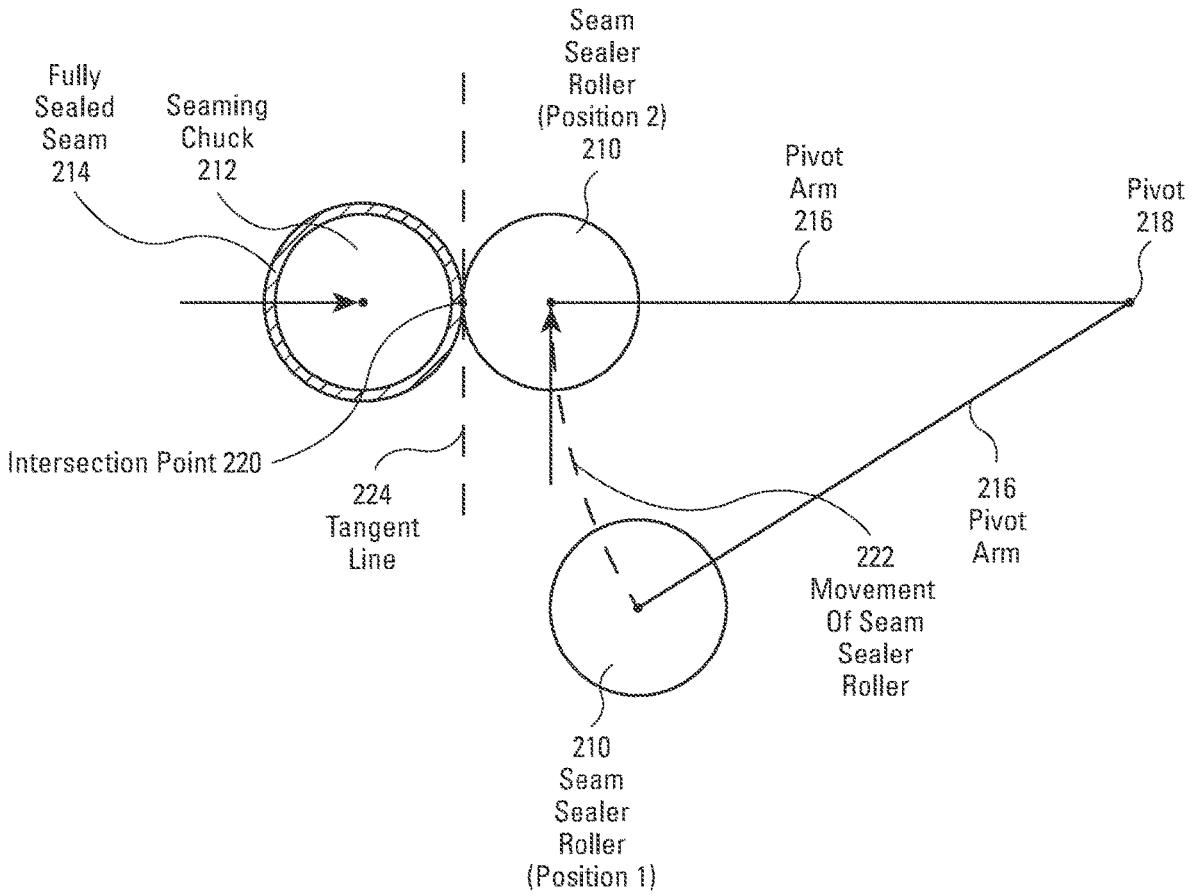
FIG. 18 is a schematic illustration of another embodiment of the invention.

FIG. 18 is a schematic illustration of another embodiment of the invention. As illustrated in FIG. 18, the seam sealer roller 210 is mounted on a pivot arm 216, which pivots around pivot 218. The seam sealer roller 210 pivots on the pivot arm 216 from a first position, such as position 1 illustrated in FIG. 18, to position 2 where the seam sealer roller engages and forms the fully sealed seam 214. The pivot arm 216 has a length which causes the seam sealer roller 210 to engage a formed seam 144, illustrated in FIG. 6, to create a fully sealed seam 214, illustrated in FIG. 18. In other words, the displacement between the seaming chuck 212 and the seam sealer roller 210 in position 2 causes the seam sealer roller 210, in position 2, to create a fully sealed seam 214 on the seaming chuck 212 by engagement of the seam sealer roller 210 at the intersection point 220 with sufficient force to form the fully sealed seam. In that regard, the pivot arm 216 has a length that creates a displacement that causes the seam sealer roller 210 to engage the seam 214 and the seaming chuck 212 to create a sufficient force to fully seal the seam 214 at the intersection point 220. As shown in FIG. 18, because the seam sealer roller 210 is mounted on pivot arm 216, it has an arcuate movement 222 to move the seam sealer roller from a non-engaged position, which is position 1, to an engaged position, position 2. Consequently, the movement 222 of the seam sealer roller does not necessarily have to be parallel along the entire path of movement of the seam sealer roller 210, but can be parallel to the tangent 224 or substantially tangent when the sewn sealer roller 210 engages the seam 214 and the seaming chuck 212.

Accordingly, the embodiment of the lid seaming apparatus 100 uses a linear motion of both the seam forming roller 106 and the seam sealer roller 108 which creates a small angle of less than about 45 degrees, and preferably less than about 10 degrees, between the motion of the seam forming roller 106 and seam sealer roller and a tangent line running through the intersection point of the seam forming roller 106 and the seaming chuck 104, when the seam is fully formed, and the seam sealer roller 108 and the seaming chuck 104 when the seam is fully sealed. Smaller angles of less than 10 degrees provide greater adjustment of the forces that are applied by the seam forming roller 106 and the seam sealer roller 108 and allow for the creation of greater forces, up to 1,000 pounds, especially between the seam sealer roller 108 and the seaming chuck 104, to provide a proper seal between the lid and the can.

What is claimed is:

1. A method of seaming a lid to a can comprising;

positioning a can lid and can in a rotary seaming chuck so that said can lid and said can rotate in response to rotation of said seaming chuck;

moving a seam forming roller in a direction towards said seaming chuck that forms an angle of less than approximately 45 degrees with a tangent line that is tangent to said seaming chuck at an intersection point of a fully formed seam and said seam forming roller;

moving a seam sealer roller in a direction towards said seaming chuck that forms an angle of less than approximately 45 degrees with a tangent line that is tangent to said seaming chuck at an intersection point of a fully sealed seam and said seam sealer roller.

2. The method of claim 1, wherein moving said seam sealer roller in said direction towards said seaming chuck further comprises:

moving said seam sealer roller in said direction towards said seaming chuck that forms an angle of less than approximately 10 degrees with said tangent line that is tangent to said seaming chuck at said intersection point of said fully sealed seam and said seam sealer roller.

3. A method of claim 2 wherein moving said seam forming roller in said direction towards the seaming chuck further comprises:

moving said seam forming roller in said direction towards said seaming chuck that forms an angle of less than approximately 10 degrees with said tangent line that is tangent to said seaming chuck at said intersection point of said fully formed seam in said seam forming roller.

4. The method of claim 2 wherein said seam sealer roller is moved using a seam sealer translating mechanism so that said seam sealer roller moves along a linear path.

5. The method of claim 2 wherein said seam sealer roller is moved using a seam sealer translating mechanism so that said seam sealer roller moves along an arcuate path.

6. The method of claim 1 wherein moving said seam sealer roller in said direction towards said seaming chuck further comprises:

moving said seam sealer roller in said direction towards said seaming chuck that forms an angle that is approximately parallel to said tangent line that is tangent to said seaming chuck at said intersection point of said sealed seam and said seam sealer roller.

7. The method of claim 6 wherein moving said seam forming roller in said direction towards said seaming chuck further comprises:

moving said seam forming roller in said direction towards said seaming chuck that forms an angle that is approximately parallel with said tangent line that is tangent to said seaming chuck at said intersection point of said fully formed seam and said seam forming roller.

8. A lid seaming apparatus comprising:

a seaming chuck that receives a can lid on a can and spins the can lid and can on a base;

a seam forming roller that is mounted on a seam forming translating mechanism that moves said seam forming roller in a direction towards said seaming chuck that forms an angle of less than approximately 45 degrees with a tangent line that is tangent to said seaming chuck at an intersection point of a fully formed seam and said seam forming roller;

a seam sealer roller that is mounted on a seam sealer translating mechanism that moves in a direction towards said seaming chuck that forms an angle of less than approximately 45 degrees with a tangent line that is tangent to said seaming chuck at an intersection point of a fully sealed seam and said seam sealer roller.

9. The lid seaming apparatus of claim 8 wherein said seam sealer translating mechanism causes said seam sealer roller to move along a linear path.

10. The lid seaming apparatus of claim 8 wherein said seam sealer translating mechanism causes said seam sealer roller to move along an arcuate path.

11. The apparatus of claim 8 further comprising:

said seam sealer translating mechanism that moves in said direction towards said seaming chuck that forms an angle of less than approximately 10 degrees with said tangent line that is tangent to said seaming chuck at said intersection point of said fully sealed seam and said seam sealer roller.

12. The apparatus of claim 11 wherein:

said seam forming roller translating mechanism moves in said direction towards said seaming chuck to form an angle of less than approximately 10 degrees, with said tangent line that is tangent to said seaming chuck at said intersection point of said fully formed seam and said seam forming roller.

13. The apparatus of claim 10 wherein:

said seam forming roller translating mechanism moves in said direction towards said seaming chuck to form an angle of less than approximately 10 degrees, with said tangent line that is tangent to said seaming chuck at said intersection point of said fully formed seam and said seam forming roller.

14. The apparatus of claim 9 wherein:

said seam sealer translating mechanism moves in said direction towards said seaming chuck that is substantially parallel to said tangent line that is tangent to said seaming chuck at said intersection point of said fully sealed seam and said seam sealer roller.

15. The apparatus of claim 10 wherein:

said seam sealer translating mechanism moves in said direction towards said seaming chuck that is substantially parallel to said tangent line that is tangent to said seaming chuck at said intersection point of said fully sealed seam and said seam sealer roller.

16. The apparatus of claim 9 wherein:

said seam forming roller translating mechanism moves in said direction towards said seaming chuck that is substantially parallel to said tangent line that is tangent to said seaming chuck at said intersection point of said fully formed seam and said seam forming roller.

17. The apparatus of claim 10 wherein:

said seam forming roller translating mechanism moves in said direction towards said seaming chuck that is substantially parallel to said tangent line that is tangent to said seaming chuck at said intersection point of said fully formed seam and said seam forming roller.

* * * * *